US008427079B2

(12) United States Patent
Van Der Veen et al.

(10) Patent No.: US 8,427,079 B2
(45) Date of Patent: Apr. 23, 2013

(54) METHOD AND DEVICE FOR DRIVING A MULTICOLOR LIGHT SOURCE

(75) Inventors: Geert Willem Van Der Veen, Veldhoven (NL); Johannes Antonius Kwakman, Veghel (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 244 days.

(21) Appl. No.: 13/060,703

(22) PCT Filed: Aug. 28, 2009

(86) PCT No.: PCT/IB2009/053771

§ 371 (c)(1),
(2), (4) Date: Feb. 25, 2011

(87) PCT Pub. No.: WO2010/026518

PCT Pub. Date: Mar. 11, 2010

(65) Prior Publication Data

US 2011/0148315 A1 Jun. 23, 2011

(30) Foreign Application Priority Data

Sep. 4, 2008 (EP) ..... 08163657

(51) Int. Cl.
*H05B 37/02* (2006.01)

(52) U.S. Cl.
USPC ..... 315/360; 315/152; 315/307

(58) Field of Classification Search ..... 315/149–159, 315/291, 307, 308, 360
See application file for complete search history.

(56) References Cited

U.S. PATENT DOCUMENTS

| | | | | |
|---|---|---|---|---|
| 6,127,783 | A * | 10/2000 | Pashley et al. | 315/149 |
| 6,445,139 | B1 * | 9/2002 | Marshall et al. | 315/291 |
| 6,630,801 | B2 * | 10/2003 | Schuurmans | 315/307 |
| 6,894,442 | B1 * | 5/2005 | Lim et al. | 315/291 |
| 7,781,990 | B2 * | 8/2010 | Huang et al. | 315/360 |
| 2002/0171373 | A1 | 11/2002 | Muthu | |
| 2005/0117190 | A1 | 6/2005 | Iwauchi et al. | |
| 2007/0171670 | A1 | 7/2007 | Zagar et al. | |
| 2008/0065345 | A1 | 3/2008 | Ooghe | |

FOREIGN PATENT DOCUMENTS

| | | | |
|---|---|---|---|
| WO | 2006054230 | A1 | 5/2006 |
| WO | 2007069149 | A1 | 6/2007 |
| WO | 2007121574 | A1 | 11/2007 |

* cited by examiner

*Primary Examiner* — Tung X Le
(74) *Attorney, Agent, or Firm* — Mark L. Beloborodov

(57) ABSTRACT

A lighting device (1) comprises a plurality of LEDs (11-14) producing light (21-24) of mutually different colors. The LEDs are driven in switching cycles (63) with a duty cycle controlled supply current of constant magnitude. In each switching cycle, each LED is first switched ON (61) and then switched OFF (62).

In a measuring mode, during one switching cycle (63B), all ON phases of all LEDs are briefly interrupted, except for one LED (11), so that a light sensor (70) measures the light from this one LED. This measurement can be used to adapt the duty cycle of this one LED. In the next switching cycle (63C), the interruption of the ON phases is compensated by extending the ON phases of all LEDs except said one LED, the extension having a duration equal to the duration ($\tau_D$) of the interruption.

18 Claims, 2 Drawing Sheets

METHOD AND DEVICE FOR DRIVING A MULTICOLOR LIGHT SOURCE

FIELD OF THE INVENTION

The present invention relates in general to the field of lighting using a plurality of dimmable light sources. Particularly, but not exclusively, the present invention relates to a lighting device comprising two or more dimmable light sources of mutually different color for producing output light with an output color that is a mixture of the colors of the contributing light sources. Since the light sources as used in practice are typically LEDs, the light sources will hereinafter simply be indicated as LEDs, but it is noted that this is not intended to limit the protective scope since the present invention can also be practiced with other types of light sources, for instance discharge lamps.

BACKGROUND OF THE INVENTION

A LED typically generates light within a narrow spectral range, which can be indicated as a point in a color space. With two LEDs of different color, the human observer will observe a resulting mix color having a color point on the line connecting the two color points corresponding to the two LED colors. The exact position on this line, i.e. the exact mix color, depends on the intensity ratio of the respective light outputs of the respective LEDs, while the intensity of the mix color can be seen as a summation of the respective individual intensities. Likewise, with three LEDs of different color, it is possible to create any mix color within the triangle defined in the color space by the three color points corresponding to the three LED colors. In a typical example, a lighting device comprises three LEDs of red, green and blue colors, respectively, but other color combinations and/or additional colors are also possible. Further, it is known to add a fourth LED, typically generating white light, if increased output intensity is desired.

It is noted that, instead of one LED per color, the device may have a plurality (array, string) of preferably identical LEDs per color, which may be connected in series or parallel and be considered to constitute one light source.

It is noted that the above is commonly known to persons skilled in the art, so a further explanation of this general background art will be omitted.

In a lighting device, the individual intensities of the individual LEDs is controlled by a controller on the basis of an input signal that defines the desired output mix color. Given that the color points of the individual LEDs are known, there is, in the case of a three LED system, a one-to-one correspondence between the output mix color and the individual LED intensities, apart from a common multiplication factor that determines the overall intensity. In the case of four or more LEDs, there are more possibilities for setting the individual LED intensities to obtain the desired output mix color. In any case, on the basis of the input signal that defines the desired output mix color, the controller can determine the individual LED intensities, for instance by consulting a memory that contains information, for instance in the form of a look-up table or a formula, defining a relationship between output color and LED intensities.

A problem in this respect is accuracy and stability. On the basis of the information stored in the memory, the controller is only capable of determining setpoints or target values for the individual LED intensities, which are translated to setpoints or target values for the individual LED control signals generated by the controller. But it may be that the response by a LED to a control signal differs from expectations, for instance as a matter of tolerances or because it changes with time, temperature, etc. If the light output intensity (flux) of a LED is not correct, the resulting output mix color may deviate noticeably from the desired color.

In order to assure that each LED produces the correct intensity, it is necessary to provide for some feedback of the actually produced intensity to the controller. Such feedback can be provided by an optical detector, typically a photodiode. Although it is possible to use individual detectors per LED, a problem would be that different detectors may give different responses. Therefore, it is better to use one single detector with a wide sensitivity range, i.e. a detector sensitive to the different wavelengths produced by the different LEDs. Consequently, since it is intended to measure the individual light output of the individual LEDs, it is necessary to briefly switch off all LEDs except the one being measured. Since LEDs and photodiodes have short response times, a measuring event may take place within a very brief time window and the interruption of the non-measured LEDs may be very short. Nevertheless, the brief interruption of the non-measured LEDs constitutes a reduction of the average light output of these LEDs, and hence a deviation of the output color and reduction of the output light intensity, which, brief as it may be, may be noticeable.

In order to avoid these artefacts, the brief interruption of the light output of the non-measured LEDs during a measuring window is compensated by a brief increase of the light output of the non-measured LEDs outside such measuring window.

A device showing all the above features is disclosed in U.S. Pat. No. 6,445,139, and for a more elaborate background explanation reference is made to this document, of which the content is incorporated herein by reference.

Generally, the light intensity of a LED is proportional to the magnitude of the current through the LED. In the device as disclosed in said document, the light intensities of the LEDs are varied by varying the current magnitude. Thus, a LED is driven with a constant current magnitude, which magnitude is controlled to have a certain desired value. Immediately before and after a measuring window, the current is boosted to have a higher magnitude than the constant desired value. Thus, averaged over a time portion including the duration of the boost and the measuring window, the average current is equal to the desired value and hence the average light intensity is equal to the desired value.

SUMMARY OF THE INVENTION

A problem of the technique as disclosed in U.S. Pat. No. 6,445,139 is that this technique can only be applied in the case of lighting devices having variable current magnitude for varying the light intensity of a LED.

Varying the current magnitude requires relatively complicated drivers. In a more economic driver design, the magnitude of the LED current is maintained constant at a nominal value, and dimming of the LED (reducing the light intensity) is performed by duty cycle control. It is noted that duty cycle control is known per se. Briefly said, the LED is repeatedly switched on and off at a predetermined switching frequency, so that the LED substantially only produces light during the ON periods and substantially produces no light during the OFF periods; the average light output is determined by the duty cycle, i.e. the ratio of the duration of the ON period to the duration of the switching cycle.

An object of the present invention is to provide intensity compensation of the individual colors to accurately achieve the desired color point target for a lighting device having duty cycle control.

A lighting device with color control and having duty cycle control is disclosed in US-2008/0065345. One sensor detects the light output of the device during a measuring window when only one light source is active while the other sources are off. In this known device, as illustrated in FIG. 4 of the document, a switching cycle starts with all LEDs being off. Then, at a later moment during this cycle, depending on the respective duty cycles, the individual LEDs are switched on, and all LEDs are switched off simultaneously at the end of a normal switching cycle. In the case of a measurement being performed, the ON phase of one LED is shifted in time, such that the final portion of the ON phase extends into the initial portion of the next cycle, when all other LEDs are off. Thus, this known device does not interrupt any LED, and there is no need for any compensation.

According to the present invention, if a LED current is interrupted for allowing intensity measurement of another LED, the interruption is compensated in another switching cycle, preferably the next switching cycle, by a corresponding increase of the duration of the ON phase. An advantage of this compensation method is that it can be implemented with a low-cost microcontroller.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
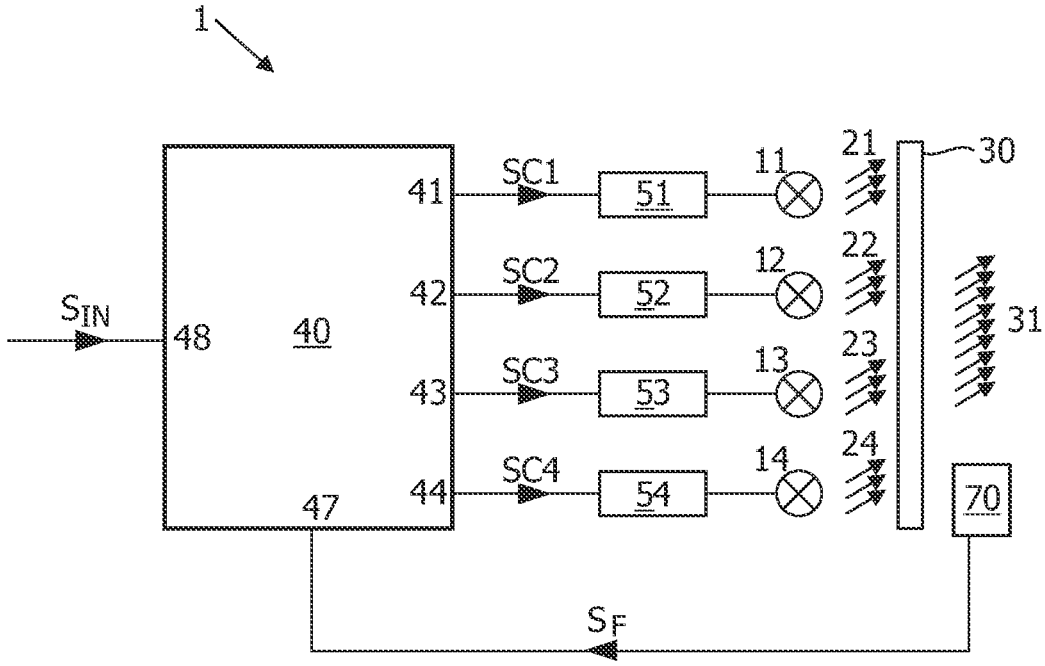
FIG. 1 schematically shows a lighting device according to the present invention.

FIG. 1 schematically shows a lighting device 1 according to the present invention. The lighting device 1 comprises a plurality of light sources. In the illustrative embodiment, four light sources 11, 12, 13, 14 are shown, each producing light 21, 22, 23, 24 with mutually different colors, respectively, which may illustratively be red, green, blue, white, respectively. These different light contributions are mixed, for instance in an optical element 30, to produce mixed output light 31.

It is noted that each light source may be an individual LED, or an array or string of LEDs. Also, a light source may be of a different type.

Each light source 11, 12, 13, 14 may be provided with an individual driver 51, 52, 53, 54, respectively. The device 1 comprises a controller 40 having control outputs 41, 42, 43, 44 coupled to control inputs of the respective drivers 51, 52, 53, 54. At these control outputs 41, 42, 43, 44, the controller 40 generates control signals SC1, SC2, SC3, SC4, respectively, for the respective drivers 51, 52, 53, 54. It is noted that the drivers may be integrated in the controller, and that the controller is directly connected to the respective lamp.

Each driver is designed to generate lamp current of a constant magnitude, depending on the control signal received at its control input. Particularly, the control signal is a digital signal which can take two values, indicated as HIGH and LOW or "1" and "0". If the control signal has one value, for instance LOW or "0", the driver interrupts its lamp current and the corresponding light source is off. If the control signal has the other value, for instance HIGH or "1", the driver produces its lamp current and the corresponding light source is on.

Figure 2:
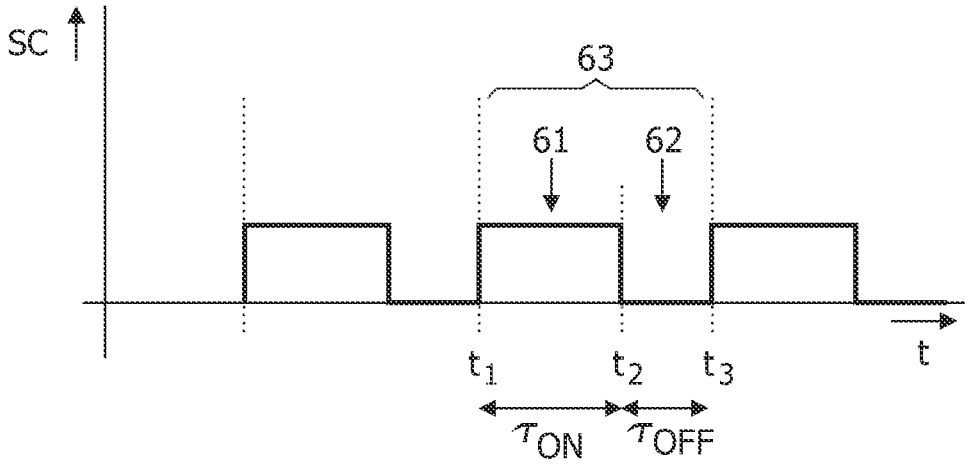
FIG. 2 is a graph schematically illustrating a control signal as a function of time during normal operation.

FIG. 2 is a graph schematically illustrating a control signal SC as a function of time during normal operation. At a first time t1, the control signal SC switches from LOW to HIGH, and remains HIGH until a time t2 when the control signal SC switches back from HIGH to LOW. The control signal SC remains LOW until a time t3 when the control signal SC switches from LOW to HIGH again, and the above cycle is repeated. From the above explanation, it should be clear that the corresponding light source would be ON from time t1 to time t2 and would be OFF from time t2 to time t3. The period from t1 to t2 will be indicated as ON period 61 having duration $\tau_{ON}$, and the period from t2 to t3 will be indicated as OFF period 62 having duration $\tau_{OFF}$. The period from t1 to t3 will be indicated as switching cycle 63 having a cycle duration T. A switching frequency f is defined as 1/T. A duty cycle Δ is defined as $\tau_{ON}$/T. When the current is flowing, the light source generates its light with nominal (or maximum) intensity $I_{NOM}$. Due to the described switching, the light source produces an average intensity $I_{AV}=\Delta \cdot I_{NOM}$ (averaged over a period longer than T).

Referring to FIG. 1, the device 1 further comprises an optical sensor 70 coupled to a measuring input 47 of the controller 40, for providing a feedback signal $S_F$ representing the actually produced light. Further, the controller 40 has an input 48 for receiving an input signal $S_{IN}$ indicating a desired color of the mixed output light 31. Based on this input signal $S_{IN}$, the controller 40 calculates duty cycles for the respective light sources 11, 12, 13, 14 and generates its corresponding control signals SC1, SC2, SC3, SC4 accordingly. Based on the feedback signal $S_F$, the controller 40 calculates a possible amendment for the control signals SC1, SC2, SC3, SC4, i.e. possible amendments for the respective duty cycles, to assure that the actual light output of each light source corresponds to the respective target value.

Figure 3:
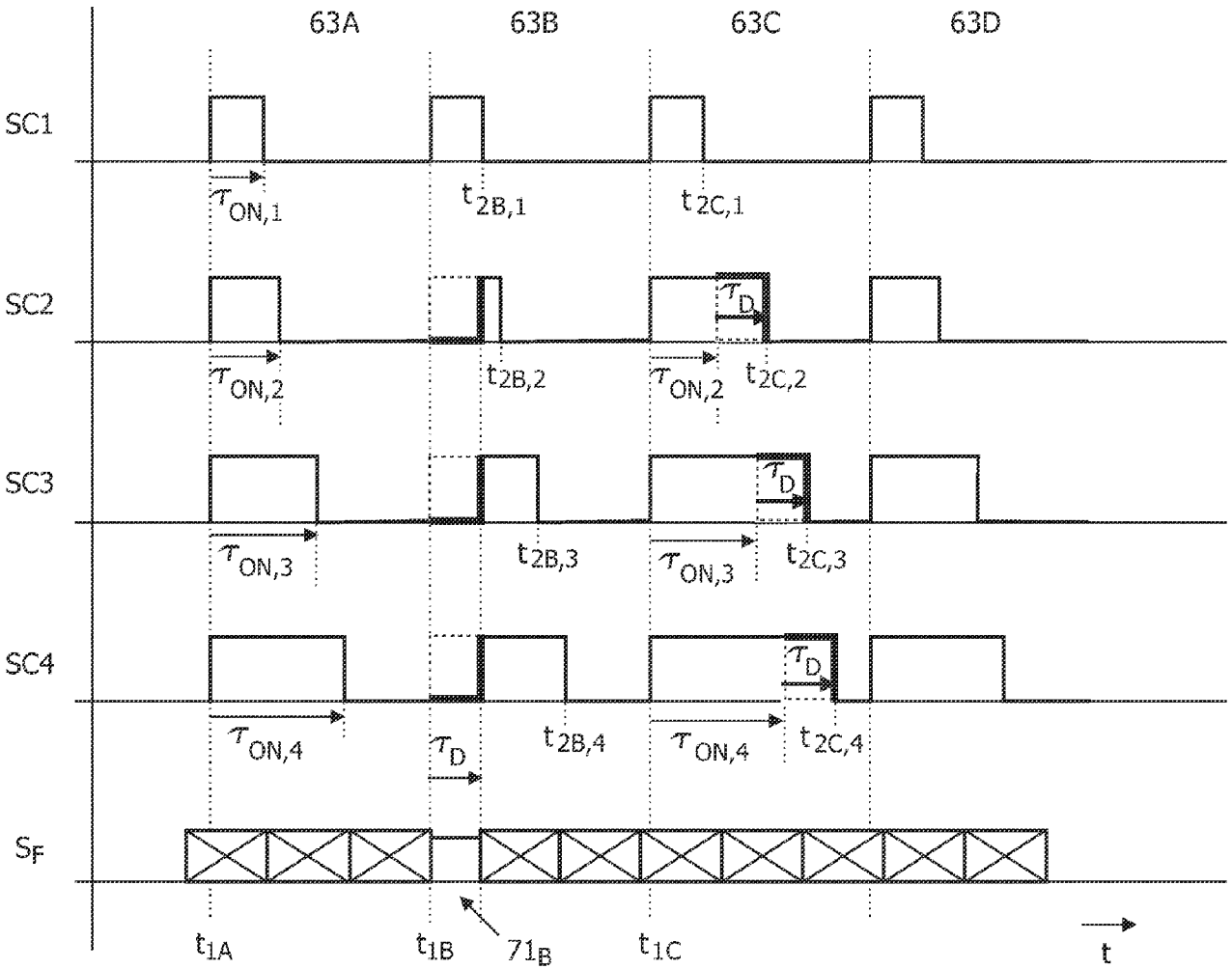
FIG. 3 is a graph comparable to FIG. 2, showing four control signals and a feedback signal during a measuring mode and a compensation mode according to the present invention.

FIG. 3 is a graph comparable to FIG. 2, showing the four control signals SC1, SC2, SC3, SC4. All signals have the same switching frequency, and the switching signals are synchronized and in phase so that the start times t1 of the switching cycles in the different control signals SC1, SC2, SC3, SC4 coincide. Further, in all switching cycles the ON periods precede the OFF periods. The duty cycles of the different control signals SC1, SC2, SC3, SC4 are shown to be mutually different, which will in general be true but which is of course not essential. In the figure, it is assumed that SC4 has the highest duty cycle, followed by SC3 and SC2, and that SC1 has the lowest duty cycle. The transition times t2 from the ON phase to the OFF phase will thus in general be mutually different for the different control signals SC1, SC2, SC3, SC4; these transition times will be distinguished by the addition of index 1, 2, 3, 4, respectively.

In FIG. 3, a first switching cycle 63A illustrates normal operation. A second switching cycle 63B illustrates operation in a measuring mode, where the feedback signal $S_F$ indicates the actual light intensity of the first LED 11. At time $t_{1B}$, the first control signal SC1 makes the transition from LOW to HIGH so that the first LED 11 is switched ON. In normal operation, also the other control signals SC2, SC3, SC4 would make the transition from LOW to HIGH at the same moment, but in the measuring mode the controller delays this transition for a brief delay duration $\tau_D$, thus providing a measuring time window 71B during which only the first LED 11 is switched ON. This can be expressed as:

$$t_{1B,2}=t_{1B,3}=t_{1B,4}=t_{1B}+\tau_D$$

Thus, the feedback signal $S_F$ received by the controller 40 during this measuring time window 71 represents the actual light intensity of the first LED 11.

It is noted that the sensor 70 may be a triggered sensor, but it is easier that the sensor 70 provides a continuous output signal, which is simply ignored by the controller 40 outside the measuring time window 71, indicated by crosses in this signal. In fact, the controller 40 may just sample the feedback signal $S_F$ during the measuring time window 71B.

All control signals SC1, SC2, SC3, SC4 make the transition from HIGH back to LOW, i.e. from the ON phase to the OFF phase, at the same moment t2 as during normal operation. This can be expressed as:

$$t_{2B,i}=t_{1B,1}+\tau_{ON,i}, \text{ for } i=1, 2, 3, 4$$

Thus, it should be clear that the duty cycle Δ2, Δ3, Δ4 of said other control signals SC2, SC3, SC4 has been reduced in this measuring mode. This is compensated in the third switching cycle 63C immediately following said second switching cycle 63B. In this third switching cycle 63C, the controller operates in a compensation mode. At time $t_{ic}$, all control signals SC1, SC2, SC3, SC4 make the transition from LOW to HIGH so that all LEDs 11, 12, 13, 14 are switched ON, as during normal operation. The first control signal SC1 makes the transition from HIGH back to LOW at the normal time $t_{2C,1}$. For the other control signals SC2, SC3, SC4, the transition from HIGH back to LOW, i.e. from the ON phase to the OFF phase, is delayed by the same brief delay duration $\tau_D$. This can be expressed as:

$$t_{2C,i}=t_{1C}+\tau_{ON,i}+\tau_D, \text{ for } i=2, 3, 4$$

Thus, averaged over the second and third switching cycles, the average duty cycle and hence the average light intensity for each of the other LEDs 12, 13, 14 is equal to the corresponding average over the first switching cycle.

It should be clear that a similar measuring mode follows in which the second LED 12 is measured, followed by a compensation mode, and the same applies to the remaining LEDs 13, 14. This is not illustrated for sake of convenience. It is noted that the next measuring mode can be performed in the next switching cycle immediately following the third switching cycle 63C, but it is also possible that the controller provides for one or more switching cycles with normal operation between a compensation mode and the subsequent measuring mode.

Further, it is possible that the controller 40 performs a measurement of the level of ambient or background light. In that case, the ON phases of all lighting sources are delayed during cycle 63B and compensated during the next cycle 63C. If all lighting sources are OFF, the feedback measurement signal $S_F$ from the sensor 70 represents the level of ambient or background light, and/or the dark current. This measurement allows the controller to correct the measurements of the light output of the different light sources by subtracting the background light. However, as long as all lighting sources are operated at a duty cycle less than 100%, their OFF phases have an overlap, particularly at the end of the switching cycles, and the controller can take the feedback measurement signal $S_F$ from the sensor 70 during such overlap as representing the level of ambient or background light.

Summarizing, the present invention provides a lighting device 1 comprising a plurality of LEDs 11-14 producing light 21-24 of mutually different colors. The LEDs are driven in switching cycles 63 with a duty cycle controlled supply current of constant magnitude. In each switching cycle, each LED is first switched ON and then switched OFF.

In a measuring mode, during one switching cycle 63B, all ON phases of all LEDs are briefly interrupted, except for one LED 11, so that a light sensor 70 measures the light from this one LED. This measurement can be used to adapt the duty cycle of this one LED. In the next switching cycle 63C, the interruption of the ON phases is compensated by extending the ON phases of all LEDs except said one LED, the extension having a duration equal to the duration $\tau_D$ of the interruption.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, instead of delaying the transition from OFF phase to ON phase in the measuring mode, i.e. to delay the ON phase, it is possible to briefly switch OFF the non-measured light sources after having been switched ON, i.e. to briefly interrupt the ON phase, one or more times.

Further, instead of delaying the transition from ON phase to OFF phase in the compensating mode, i.e. to extend the ON phase, it is possible to briefly switch ON the light source concerned after having been switched OFF, i.e. to briefly interrupt the OFF phase, one or more times.

Further, it is not essential that the compensation mode takes place in the cycle following the cycle of the measuring mode. It is possible that the compensation mode cycle precedes the measuring mode cycle, and it is even possible that the compensation mode takes place in the same cycle as the measuring mode. This does not make a difference for the time average; however, the embodiment as described is easier to implement. It is even not essential that the compensation mode takes place in the cycle immediately adjacent to (following or preceding) measuring mode cycle: it can be acceptable if one or more cycles are separating the measuring mode cycle and the compensation mode cycle, but this depends on the duration of the cycles and the temporal sensitivity of the human eye. Assume that the temporal sensitivity of the human eye is about 10 ms; assume further that the current cycles have a duration of 1 ms: in such case, it would be acceptable to have the measuring mode cycle and the compensation mode cycle separated by as much as eight cycles, because the average over 10 ms would still give the correct color impression. Nevertheless, compensation in the next cycle, as described, is preferred.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/ distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Method for driving a lighting device comprising a plurality of light sources producing light of mutually different colors, wherein the light sources are driven in switching cycles with a duty cycle controlled supply current of constant magnitude, wherein, in each switching cycle, each light source is first in an ON phase and then in an OFF phase;

the method comprising the steps of:

in a measuring mode, selecting one light source to be measured and, during one switching cycle, briefly interrupting all ON phases of all non-selected light sources simultaneously; and in a compensation mode, compensating said interruption of the ON phases by briefly interrupting the OFF phases of said non-selected light sources, the interruption of the OFF phases in the compensation mode having a duration equal to the duration of the interruption of the ON phases in the measuring mode.

2. Method according to claim 1, wherein the compensation mode is executed in a switching cycle different from the cycle in which the measuring mode is executed.

3. Method according to claim 2, wherein the compensation mode is executed in a switching cycle later than the cycle in which the measuring mode is executed.

4. Method according to claim 3, wherein the compensation mode is executed in the switching cycle immediately following the cycle in which the measuring mode is executed.

5. Method according to claim 1, wherein in the measuring mode the interruption of the ON phases of said non-selected light sources is performed at the beginning of the switching cycle as a delay of the transition from the OFF phase to the ON phase.

6. Method according to claim 1, wherein in the compensation mode the interruption of the OFF phases of said non-selected light sources is performed at the beginning of the OFF phase as a delay of the transition from the ON phase to the OFF phase, thus effectively extending all ON phases of said non-selected light sources by said duration.

7. Method according to claim 1, wherein in the measuring mode during the interruption of the ON phases of said non-selected light sources the light output of the device is measured, and the measurement result is compared with a target value for the light output of said selected one light source.

8. Method according to claim 1, further comprising the steps of repeating the measuring mode and compensation mode for different selected light sources.

9. Method according to claim 8, wherein the measuring mode for a second selected light source is executed in the cycle immediately following the cycle in which the compensation mode for the first selected light source is executed.

10. Method according to claim 1, further comprising the steps of performing an ambient measuring mode in which, during one switching cycle, all ON phases of all light sources are briefly interrupted; and performing an ambient compensation mode in which said interruption of the ON phases is compensated by briefly interrupting the OFF phases of all light sources, the interruption of the OFF phases in the ambient compensation mode having a duration equal to the duration of the interruption of the ON phases in the ambient measuring mode.

11. Lighting device comprising a plurality of light sources producing light of mutually different colors;

wherein the device comprises a controller programmed to perform the method of claim 1.

12. Lighting device according to claim 11, further comprising:

duty cycle supply means for supplying each light source with a duty cycle controlled supply current of constant magnitude;

the controller being adapted for generating control signals for controlling the duty cycle supply means such as to control the duty cycle switching of the respective supply currents for the respective light sources, in switching cycles having a predetermined cycle duration, the switching cycles of all light sources being synchronized and in phase, and wherein each switching cycle for each light sources consists of an ON phase followed by an OFF phase; and a light sensor arranged for receiving the output light from the lighting device, which is a mixture of the individual light outputs from the individual light sources, the light sensor being coupled to an input of the controller for providing the controller with a feedback measuring signal.

13. Device according to claim 12, wherein the controller is designed to calculate, on the basis of a desired color and intensity of the output light of the lighting device and on the basis of the feedback measuring signal received from the light sensor, the durations of the ON phases of the respective supply currents;

wherein the controller is capable of operating in a normal operational mode, in which the controller, in each switching cycle:

sets the start time of the ON phases of each supply current for each lighting source to coincide with the start time of the switching cycle, and sets the duration of the ON phase of each supply current for each lighting source to be equal to said calculated duration.

14. Device according to claim 12, wherein the controller is designed to calculate, on the basis of a desired color and intensity of the output light of the lighting device and on the basis of the feedback measuring signal received from the light sensor, the durations of the ON phases of the respective supply currents;

wherein the controller is capable of operating in a measuring mode, in which the controller selects one lighting source of which the actual light intensity is to be measured, and in which the controller, in a first switching cycle:

sets the start time of the ON phase of the supply current for this selected one lighting source to coincide with the start time of the switching cycle;

sets the duration of the ON phase of the supply current for this selected one lighting source to be equal to said calculated duration;

within the ON phase of the supply current for said selected one lighting source, briefly interrupts the ON phases of the supply currents for all non-selected lighting sources by a brief delay duration, simultaneously for all said non-selected lighting sources; and sets the effective durations of the ON phases of the supply currents for all non-selected lighting sources to be equal to said calculated duration minus said delay duration;

wherein the controller is capable of operating in a compensation mode, in which the controller:

sets the start time of the ON phases of each supply current for each lighting source to coincide with the start time of the second switching cycle;

sets the duration of the ON phase of the supply current for said selected one lighting source to be equal to said calculated duration; and sets the durations of the ON phases of the supply currents for all non-selected lighting sources to be equal to said calculated duration plus said delay duration.

15. Device according to claim 14, wherein the controller operates in the compensation mode in a second switching cycle immediately following said first switching cycle.

16. Device according to claim 14, wherein the controller, in the measuring mode, delays the start times of the ON phases of the supply currents for said other lighting sources by a brief delay duration with respect to the start time of the switching cycle.

17. Device according to claim 14, wherein the controller is designed to regularly enter the measuring mode, each time selecting a different lighting source as said one lighting source, and each time followed by a compensation mode.

18. Device according to claim 14, wherein the controller is designed, in the measuring mode, during said delay duration, to consider the feedback measuring signal received from the sensor, to compare this signal with a desired output light intensity of said selected one lighting source, and, if this comparison shows a deviation, to adapt the calculated duration of the ON phase of the supply current for said selected one lighting source.

* * * * *